United States Patent [19]

Patton et al.

[11] 4,230,180

[45] Oct. 28, 1980

[54] ISOLATING PACKER UNITS IN GEOLOGICAL AND GEOPHYSICAL MEASURING CASINGS

[75] Inventors: Franklin D. Patton, West Vancouver; James D. McFarlane, Vancouver, both of Canada

[73] Assignee: Westbay Instruments Ltd., West Vancouver, Canada

[21] Appl. No.: 959,843

[22] Filed: Nov. 13, 1978

[51] Int. Cl.[2] ..... E21B 47/00; E21B 33/124

[52] U.S. Cl. ..... 166/185; 166/100; 166/191; 166/264

[58] Field of Search ..... 166/185, 191, 100, 264, 166/250

[56] References Cited

U.S. PATENT DOCUMENTS

| | | | |
|---|---|---|---|
| 2,618,340 | 11/1952 | Lynd | 166/250 |
| 2,818,120 | 12/1957 | Whitton | 166/191 X |
| 2,831,541 | 4/1958 | Conover | 166/191 X |
| 2,951,538 | 9/1960 | Martin | 166/100 X |
| 2,978,046 | 4/1961 | True | 166/264 X |
| 3,500,911 | 3/1970 | Farley et al. | 166/250 |

FOREIGN PATENT DOCUMENTS

| | | | |
|---|---|---|---|
| 38065 | 12/1935 | Netherlands | 166/185 |

*Primary Examiner*—Ernest R. Purser

*Attorney, Agent, or Firm*—Fulwider, Patton, Rieber, Lee & Utecht

[57] ABSTRACT

The isolating packer unit is made up of a cylindrical measuring casing one end of which is connected by a cylindrical coupler tube to an end of a similar measuring casing, this coupler tube having a measuring port normally closed by a valve which is operable from within the tube to open the port. An elongate elastic packer tube is mounted on and concentric with each casing and is secured at its ends to the casing. When the packer unit is in a well or bore hole, the packer tubes are expanded or inflated by fluid directed thereinto to engage the wall of the well or bore hole to isolate the measuring port of the coupler tube from the portions of the well or bore hole above and below the packer unit.

11 Claims, 13 Drawing Figures

Fig. 4.
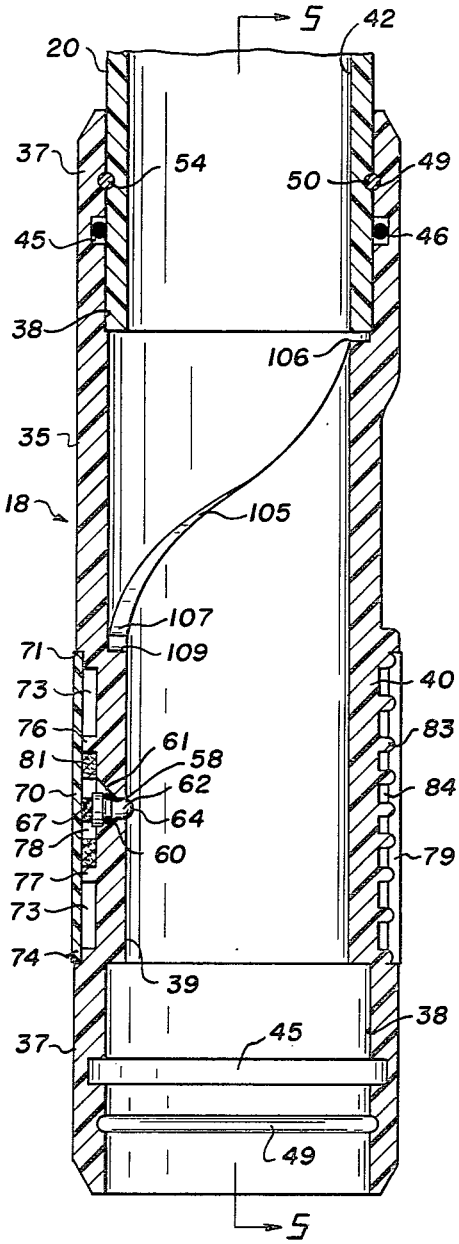
Fig. 5.
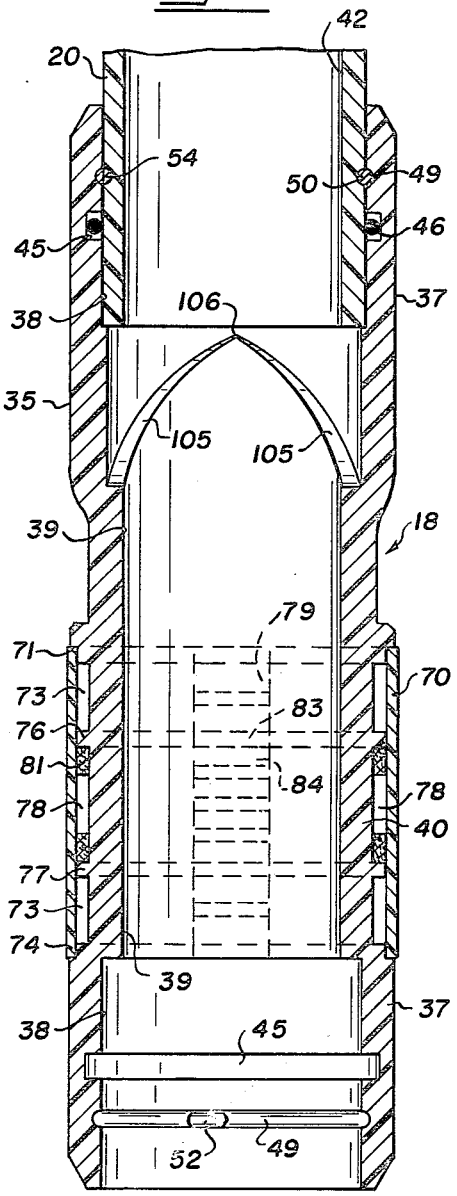
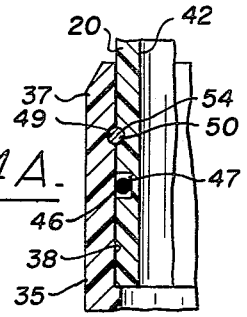
Fig. 4A.

ISOLATING PACKER UNITS IN GEOLOGICAL AND GEOPHYSICAL MEASURING CASINGS

FIELD OF THE INVENTION

This invention relates to isolating packer units in geological and geophysical measuring casing assemblies which are inserted in wells or bore holes so that instruments such as probes can be moved through the casing assemblies to take measurements and/or samples.

DESCRIPTION OF THE PRIOR ART

It is common for internally grooved casings to be placed in wells or drill holes to permit an inclinometer to be inserted inside the casing to measure the inclination of the casing at various depths and at different times. Movement of the surrounding soil or rock can be inferred by noting changes in the inclination of the casing between successive readings. However, the existing inclinometer casings are not suitable for making numerous piezometric measurements to establish and monitor the distribution of fluid or gas pressure on the exterior walls of the casing. Occasionally, the bottoms of existing types of inclinometer casing can be left open so that they can be used to measure fluid or gas pressure and to take samples at a single point. However, even in this case it is difficult to ensure that a positive hydraulic seal has been made on the exterior of the casing to ensure the necessary hydraulic isolation of the measuring point. Furthermore, it has been practically impossible to achieve a positive mechanical coupling between the soil or rock in the walls of drill holes and inclinometer casings where adverse field conditions exist, for example, where the drill hole intersects large voids or where the casing must be installed at great depths.

It is also common for one or two piezometric (fluid or gass pressure) measurements to be made in a single well and occasionally as many as four different locations are monitored in a single well. However, in these cases separate casings or individual hydraulic or pneumatic tubing are required to reach each piezometer location and there is a practical limit to about three or four installations that can be successfully placed in a single well. A common limiting factor is the inability of the prior methods to successfully isolate a large number of piezometric measurement locations from each other. Another current method of making several piezometer measurements in a single well is to install electrical or electronic devices in the well. However, there is a practical limit to the number of such devices that can be successfully installed and sealed in a well and these devices are every susceptible to errors during longterm monitoring programs as moisture seals tend to leak disturbing the electric or electronic circuitry. These devices are also susceptible to damage from lightning discharges. Existing pneumatic and electrical or electronic devices cannot easily be checked or recalibrated following installation. Thus, the quality of their data cannot be verified.

When currently available pneumatic, electrical and electronic piezometers are sealed in a well, fluid or gas samples cannot be taken. Therefore, another well must be drilled for fluid or gas sampling. Fluid or gas samples are often taken in wells for analysis of the quality or chemical composition. However, methods of sampling do not permit a high density of sampling points down a well. Furthermore, it has been possible to hydraulically seal the sampling points from each other.

It is important in the sampling of fluids in a well that the method of isolating the sampling points does not contaminate the fluid or gases which are being sampled. Thus, the sampling tool, sampling points and sealing methods should have a negligible effect on the existing hydrologic environment during installation and the sampling process.

SUMMARY OF THE INVENTION

The present packer units form part of a casing assembly that may extend from the top to the bottom of a well or bore hole. These units make it possible to take measurements or samples at as many different levels in the well or bore hole as practical without each measurement or sample being contaminated by conditions at the other levels. The packer units permit positive mechanical coupling with the soil or rock of the drill hole even under adverse field conditions, thereby providing hydraulic isolation of the measurement or sample points from each other. The measurements or samples are taken at the desired levels through measuring ports in couplers forming part of the casing assembly at said levels. Each packer unit includes one of these couplers, and casings of the assembly above and below the coupler in axial alignment therewith. An elastic packer tube or bag mounted on and concentric with each of said casings is inflatable from the top of the well or bore hole to engage the sides thereof and thereby seal and isolate the measuring port from areas of the well or bore hole above and below the packer unit. Thus pressure and temperature measurements or fluid samples, for example, can be taken at the different levels without the danger of being affected by temperatures, pressures and fluids at other levels. Thus, each measuring port is isolated from all of the other measuring ports of the casing assembly.

This apparatus is very simple in construction and easy to operate from above the well or bore holes. It can very readily be put into operative position within a well or bore hole, and the measuring ports quickly and easily isolated from each other.

An isolating packer unit in accordance with this invention comprises axially aligned and spaced measuring casings through which can be moved instruments or probes for taking measurements and samples in wells or bore holes, a coupler tube connected at opposite ends to ends of the casings, said casings and tube forming a common passageway through which instruments or probes can be moved to take measurements and samples, a measuring port in the coupler tube permitting communication between the interior and exterior thereof, a valve normally closing the measuring port and operable from within the tube to open said port, an elongate elastic packer tube mounted on and concentric with each casing, said each casing extending through its packer tube and beyond the ends thereof, securing means fastening the ends of each packer tube to the casing extending through the latter packer tube, and means for directing fluid from the top of the well or bore hole in which the packer unit is located into both of said packer tubes to expand the packer tubes to engage the wall of said well or bore hole to isolate the measuring port of the coupler tube from the portions of the well or bore hole above and below the packer unit.

BRIEF DESCRIPTION OF THE DRAWINGS

Isolating packer units in accordance with this invention are illustrated by way of example in the accompanying drawings, in which FIG. 1 diagrammatically illustrates a packer unit in a well or bore hole.

FIG. 4 is a vertical section view through the coupler of this packer unit, FIG. 4A is a fragmentary sectional view illustrating an alternative form of sealing connecting means between a coupler and a casing, FIG. 5 is a vertical section through the coupler taken at right angles to FIG. 4.

DESCRIPTION OF THE PREFERRED EMBODIMENTS

Figure 1:
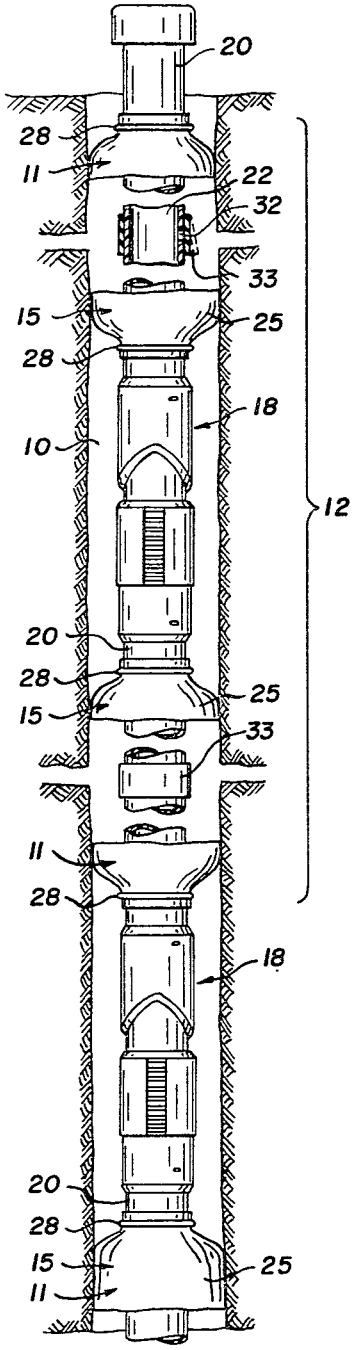

Referring to FIG. 1 of the drawings, 10 is a well or bore hole, and 11 is a geology or geophysical casing assembly made up of a plurality of packer units 12, each of said units comprising two packers 15 interconnected by a coupler 18. The packers 15 include elongate casings 20 which are illustrated at adjacent ends by said couplers to form a passageway 22 extending longitudinally through the casing assembly.

In this example, the casing 20 of each packer 15 extends through and is substantially concentric with an expandable cylindrical packer tube, membrane or bag 25 formed of suitable elastic or stretchable material, such as natural or synthetic rubber or a plastic such as urethane. Urethane is preferable for this purpose because it is readily moldable, and has high strength and abrasion characteristics when expanded. The packer tube is clamped at opposite ends of casing 20 by circular fasteners or clamps 28. The ends of casing 20 project beyond the ends of the packer tube 25.

As the packer tube is molded, it is preferable to mold it so that the ends portions 30 are thicker than the central section 31 extending therebetween. The thicker portions are located at points where the packer tube is subjected to the greatest strain, while the thinner central section will readily fit against the irregular surface of the well 10 to form a fluid-tight seal.

Figure 2:
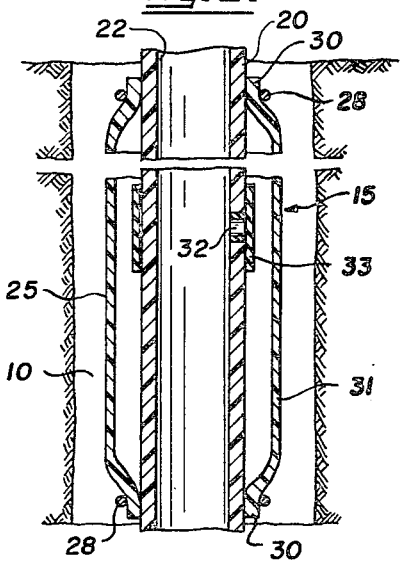
FIG. 2 is an enlarged longitudinal section of one form of packer tube in the collapsed condition.
Figure 3:
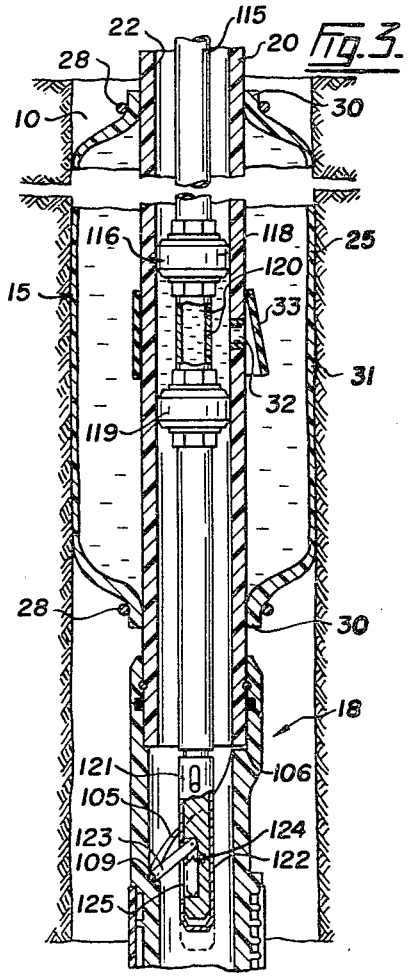
FIG. 3 is a view similar to FIG. 2 showing the packer tube in the inflated and sealing condition.

In this example, the elastic tube 25 of the packer 15 is inflated through an inflating port 32 in casing 20 of said packer and normally is closed by a suitable check valve which opens outwardly therefrom. In this example, the check valve is in the form of a relatively wide elastic band 33 which fits around casing 15 within bag or tube 25 and over the inflating port. FIG. 2 shows the check valve or band 33 in the closed position, and FIG. 3 shows the valve or band in the open position. When pressure is exerted radially through port 32, the adjacent edge of band 33 is forced outwardly to open the port. When the pressure within bag or tube 25 exceeds pressure within casing 20, the check valve 33 will close and remain closed.

An example of a coupler 18 for a packer unit 12 is illustrated in FIGS. 4 and 5. This coupler is in the form of a tube 35 formed of plastic, metal or the like. The ends 37 of the tube are open and have annular enlargements 38 therein and opening outwardly therefrom for receiving the ends of casings 20. If desired, this arrangement can be reversed, that is, the ends of the coupler tube may be of such size as to fit into the ends of the casings. The interior of bore 39 of the central section 40 of tube 35 is axially aligned with and of the same diameter as the interior of bore 42 of the casings 20. It is to be understood that any suitable type of coupler may be used in place of coupler 18.

Suitable connecting and sealing means is provided between each end of the coupler tube and the adjacent end of a casing. In this example, sealing connecting means is provided in the enlargement 38 of each end 37 of the coupler tube. This sealing connecting means includes an annular groove 45 in the inner surface of the coupler tube and containing a sealing ring 46 therein. As an alternative, said groove 45 may be replaced by a groove 47 in the outer surface of casing 20, in which case sealing ring 46 is located in this groove 47, as shown in FIG. 4A. This ring receives and fits tightly around the end of casing 20 within enlargement 38. The groove 45 is spaced inwardly from the adjacent end of tube 35. Another annular groove 49 is formed in the inner surface of tube 35 between groove 45 and the adjacent tube end, groove 45 overlying and registering with a similar annular groove 50 formed in the outer surface of the end of casing 20. An orifice 52 extends through the wall of tube 35 and opens into the groove 49 thereof, see FIG. 4. A flexible shear fastener 54 extends through the registering annular grooves 49 and 50 to lock coupler 18 and casing 20 together. This cord is insertable into the registering grooves through orifice 52, and can be moved through said orifice. The fastener may be in the form of a flexible wire, strand or cord which is strong enough to prevent relative longitudinal movement between the coupler tube and the casing. Any other suitable connecting and sealing means may be used, such as normal male and female pipe threads and gaskets between each end of the coupler tube and the adjacent casing.

A measuring port 58 is formed in the wall of coupler tube 35 spaced from the ends of said tube. This port is normally closed by a suitable valve which can be opened from within the tube. An example of a valve suitable for this purpose is shown in FIGS. 4 and 5.

A valve 60 having a seal in the form of an O-ring 61 is seated in port 58 and has a stem 62 extending through the port and slightly into the bore 39 of tube 35. This stem preferably has a rounded end 64. Suitable means is provided for normally retaining valve 60 in the closed position, and in this example, an elastic pad 67 presses against the valve to retain the latter seated in and closing port 58. The method of retaining this pad in position will hereinafter appear.

Port 58 is provided to enable measurements, such as pressure and temperature measurements, to be taken in the area surrounding coupler 18 within bore hole 10 and between packers 15. Samples of gases or liquids in the bore hole and/or of the material in which the bore hole is formed can also be taken in through port 58.

As it is desirable in most cases to protect the port and valve as much as possible from particles of dirt, a shield in the form of wide band 70 can extend around the outer surface of coupler tube 35 and preferably fits in a wide annular groove 71 formed in the outer surface of the tube and overlying but spaced from valve 60. By referring to FIG. 4 it will be seen that the groove 71 overlies another annular groove 73 which is formed in and extends around the outer surface of the coupler tube, said groove 73 being narrower than groove 71 so as to form annular shoulders 74 on which band 70 seats. A pair of spaced ribs 76 and 77 project upwardly from the bottom of groove 73 and form a groove or passage 78 therebetween. It will be noted that valve 60 and elastic pad 67 are located within passage 78 of groove 73 beneath cover band 70 and that said cover band retains the pad in position on the valve. The ribs 76 and 77 support cover band 70 against external pressure and keep it clear of valve 60.

Cover band 70 is formed with a relatively large opening 79 therein, this opening preferably being spaced away from port 58, and in this example is on the opposite side of tube 35 from the port. The passage 78 between ribs 76 and 77 extends in opposite directions from band opening 79 to port 58. If desired, this passage can be filled with a suitable filter material 81 which prevents particles from travelling to the port and its valve. In addition, short annular ribs 83 may be formed on and project outwardly from the bottom of space or passageway 78 within the cover band opening 79. These ribs have spaces 84 therebetween, some of which are located in passage 78. The spaces 84 located in passage 78 are in communication at opposite ends thereof with the passage. These ribs 83 help prevent the opening 79 from being clogged with dirt.

Figure 6:
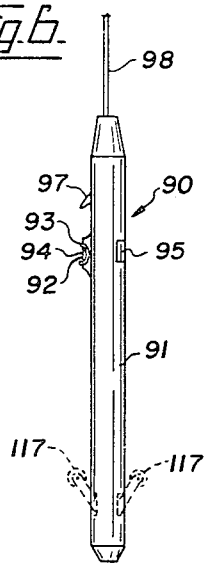
FIG. 6 is a diagrammatic elevation of a probe that can be used in this apparatus.
Figure 7:
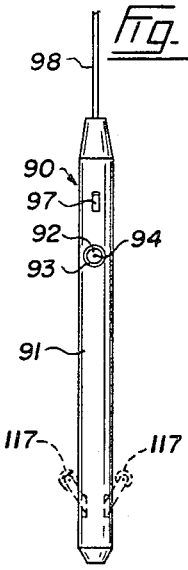
FIG. 7 is an elevation of the probe at right angles of FIG. 6.

FIGS. 6 and 7 illustrate an example of a probe or instrument 90 that can be used with the casing assembly 11. This probe is in the form of an elongate cylindrical casing 91 having a raised or ported face plate or surface 92 facing laterally therefrom, said face plate having a circular and resilient ring seal 93 thereon and projecting therefrom. A port 94 is located in face plate 92 within ring seal 93 and communicates with the interior of the probe. On the opposite side of the bore casing is an operating plate or shoe 95 which is normally retracted but which can be moved a little outwardly in the radial direction. The probe casing also has an outwardly and downwardly extending stop arm 97 radiating therefrom. Although this arm may be fixed, it is preferably retractable into the casing. In addition, the stop arm preferably is depressible when the probe is being moved upwardly, but not when the probe moves downwardly. A cable 98 is connected to the upper end of probe 90 by means of which the latter can be lowered through the passageway 22 in casing assembly 11 and drawn upwardly therethrough. This probe contains whatever mechanisms are necessary to make geophysical measurements, such as to measure temperatures, pressures and the like and to take samples of gas, liquid or particulate material. It also includes the necessary mechanism and controls for extending and retracting operating plate 95 and stop arm 97. The hydraulic, pneumatic or electrical connections for the probe are within or extend along the side of cable 98. As this probe does not form a part of the present invention, it is not necessary to describe herein the various mechanisms thereof.

Suitable stop means is provided on coupler tube 35 so positioned relative to measuring port 58 as to stop probe 90 in the tube in correct operating position at the measuring port for taking measurements and samples through said port. In coupler 18, this stop means comprises a pair of helical shoulders 105 on the inner surface of the wall of tube 35 and curving away from each other from adjacent outer ends 106 inwardly of the tube and back to adjacent inner ends 107 on the opposite side of the tube from said outer ends. A stop surface 109 is formed on the inner surface of the coupler tube at the inner ends 107 of helical shoulders 105.

When probe 90 moves downwardly through the passageway 22 into the tube 35 of probe 18, the projecting stop arm 97 of the probe engages a portion of one of the shoulders 105. As the probe continues to move downwardly, the stop arm rides on the shoulder with which it is in engagement and is rotated and guided on to the stop surface 109. The helical surfaces and the stop surface are so located that when the stop arm of the probe is located on the stop surface, the probe is in correct operating position both longitudinally and circumferentially at measuring port 58. With the illustrated probe 90, the face plate 92 thereof with the ports therein is opposite port 58 at this time, and the seal ring 93 surrounds said measuring port. When operating plate 95 is moved outwardly, it engages the wall of coupler tube 35 at a point opposite the measuring port, and this shifts the probe 90 laterally until seal 93 engages the inner wall of the tube around the measuring port to isolate the latter from the rest of the interior of the coupler tube. At the same time, face plate 92 presses against stem 62 to lift valve 70 off its seal. The probe can now be operated to take the desired measurements or samples.

Two of the packers 25 and the coupler therebetween constitute an isolating packer unit 12 embodying this invention, as shown in FIG. 1. As there are a plurality of these packer units in succession in the well 10, the packer 25 at the lower end of one isolating unit may serve as the packer at the upper end of the next isolating unit down the well. However, if it is desired to take measurements or samples from relatively small isolated areas spaced some distance from each other, then each of the isolating packer units may have its own upper and lower packers.

The geological and geophysical measuring casing assembly 11 is made up of the packers 25 and their couplers 18 which are secured together to build up said assembly as the latter is lowered into well 10. The bags or tubes 25 of the packers are deflated at this time. Once the assembly is in position, a suitable fluid, such as air or water, is directed through the inflating ports 32 to inflate or expand the packer tubes or bags 25 until they fit snuggly against the wall of the well. Inflation pressures appreciable in excess of the natural fluid or gas pressures are commonly used to ensure a good seal between the bags 25 and the walls of the well. If the bottom of the casing assembly is closed, the inflating fluid can be directed down through the passageway 22 therein with sufficient pressure to open the check valves 33 and to inflate the packer bags or tubes. However, a preferred way is to direct the inflating fluid into each inflating port on its own. This may be accomplished by a conventional or modified drill rod 115 having a conventional or modified double-packer arrangement 116 near its lower end (see FIG. 3). This arrangement has upper and lower packers 118 and 119 of such size as to slidably fit within casing 20. The packer arrangement 116 also has one or more orifices 120 formed in rod 115 between the packers 118 and 119. The lower end of rod 115 is formed with a reduced portion 121 upon which a sleeve 122 is mounted for limited vertical movement. A stop arm 123 swingably mounted within a slot in the end portion 121 can be swung outwardly to a downwardly-inclined position by a biasing spring 124. When sleeve 122 is in a normal lower position, it retains arm 123 retracted in its slot, and when said sleeve is moved upwardly, a slot 125 therein registers with the stop arm, thereby allowing said arm to swing outwardly.

In order to move the packer arrangement 116 into operative position, it is moved downwardly through casing passageway 22 until sleeve 122 engages the bottom of the well. This action results in sleeve 122 being moved upwardly to allow stop arm 123 to swing outwardly. Then rod 115 is drawn upwardly until the packer arrangement is in the packer 15 at the desired level, following which the rod is lowered until arm 123 engages the stop 109 in the coupler 18 below said packer. The stop arm and said coupling stop 109 are so located relative to the inflating port 32 of the adjacent packer 15 that the packers 118 and 119 are above and below said port and the packer arrangement orifices 120 are substantially aligned therewith.

When the fluid is pumped down rod 115 with the packer unit 116 in the position shown in FIG. 3, the fluid emerges through orifices 120 and passes through port 32, the pressure of the fluid forcing valve 33 to the open position.

If permanent seals are desired, the deflated packer tubes or bags 25 may have cement, grout or gel therein which hardens or sets when mixed with water. In this case, water would be pumped down through the rod 115 and into the packer bag or tube to inflate the latter and to moisten the material therein eventually hardens or sets to form a permanent seal. Alternatively, cement, grout or gel may be pumped from the surface into bags 25 through tube or drill rod 115.

Each isolating packer unit 12 makes it possible to take measurements or samples from a given area in well 10 without fear of contamination from gases or chemicals from other levels within the well. These isolating units are very simple in construction and are very easy to install. Any desired number of these isolating units may be connected together to operate in wells or drill holes of any depths.

Figure 8:
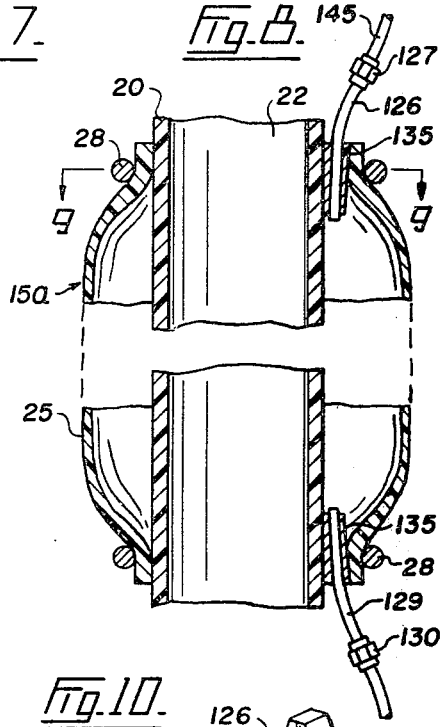
FIG. 8 is a vertical section through an alternative form of packer tube.
Figure 9:
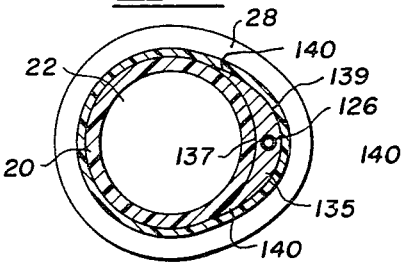
FIG. 9 is a horizontal section taken on the line 9—9 of FIG. 8.
Figure 10:
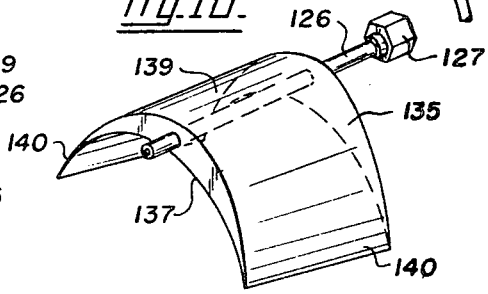
FIG. 10 is an enlarged perspective view of a protective insert of the packer tube of FIG. 8.

FIGS. 8, 9 and 10 illustrate a packer 15*a* for the isolating packer units and having an alternative means for directing fluid into the packer tube or bag 25 thereof. In this example, the inflating port 32 and its check valve 33 are omitted, and a pipe 126 extends into the upper end of packer tube 25, this pipe having a coupler 127 on its outer end. Another short pipe 129 extends into the packer tube 25 at its lower end, and has a coupler 130 on its outer end. The pipes 126 and 129 extend into the packer tube beneath the clamps 28. Suitable means is provided for providing a fluid-tight seal at these points. In this example, each of the pipes 126 and 129 is molded into and extends through a protective insert 135, shown in FIG. 10. This insert is formed of a relatively soft sealing composition such as urethane. Each pipe is molded in and extends through its insert 135. The insert preferably has an inner surface 137 shaped to fit around the surface of a casing 20, and an outer curved surface 139 which tapers laterally to form very thin side edges 140 of the insert. With this arrangement, the insert is relatively thick in the longitudinal center thereof, see FIG. 10, and tapers to its side edges 140. The pipe 126 or 129 extends through the thick middle of the insert.

The lower pipe 129 of each packer is connected to the upper pipe 126 of the packer immediately below it. The lower pipe 129 of the last packer in the series within the well is closed by a suitable plug, while the upper pipe 126 of the uppermost packer is connected to a hose 145 leading to the top of the well and to a source of pressurized fluid for inflating the packer tubes.

The packers 15*a* operate as described above, excepting that their respective packer tubes 25 are inflated by fluids directed thereinto through the pipes 126. The fluid is pumped at a suitable pressure until all of these packer tubes or bags are completely inflated to seal off the spaces between the respective packers 15 of the packer unit 12.

Figure 11:
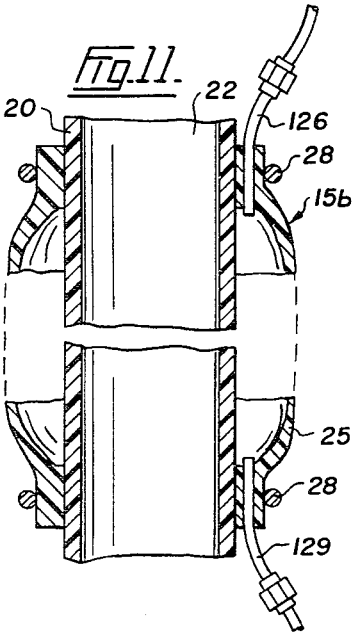
FIG. 11 is a vertical section through another alternative form of packer tube.

FIG. 11 illustrates a packer 15*b* of an isolating packer unit having an alernative method of sealing the pipes 126 and 129 in the upper and lower ends of the packer tube or bag 25. As the packer tube or bag is formed of moldable material, the pipes 126 and 129 are molded in the ends of the tube or bag when the latter is formed. The pipes 126 and 129 extend through the ends and open into the interior of the packer tube or bag.

The packers of this embodiment of the invention are inflated in the manner described in connection with the alternative of FIGS. 8, 9 and 10.

Figure 12:
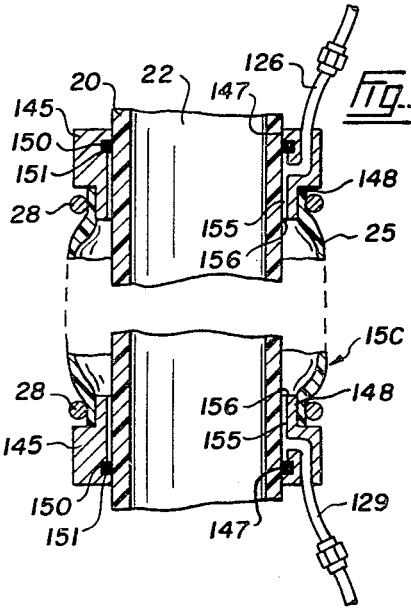
FIG. 12 is a vertical section through a further alternative form of packer tube.

FIG. 12 illustrates a packer 15*c* incorporating another alternative method of connecting the pipe 126 and 129 to the packer tubes or bags 25. In this example, a packer head 145 is provided for each of these pipes. Each packer head is formed of moldable material such as urethane and is formed with a central bore 147 which fits tightly on casing 20. The packer head has an annular notch 148 in its inner end into which the adjacent end of a packer tube or bag 25 fits, said packer tube being secured in position on the head by the clamp 28. An internal annular groove 150 is formed in the packer head and has a suitable seal therein, such an O-ring 151 which is pressed against the outer surface of casing 20. The pipe 126 or 129 is molded in head 145 and extends from the outer end thereof into the bore 147. An axial slot 155 is formed in the bore surface of head 145 and opens out therefrom at the inner end 156 of the head.

With the arrangement of FIG. 12, fluid is pumped into the packer tube 25 through pipe 126. This fluid travels through the pipe into the axial slot 155 of the upper head 145 and then into the interior of the packer tube or bag. If the illustrated packer is connected to the packer therebelow, fluid travels through the slot 155 of the lower packer head 145 and through pipe 129 into the upper packer of the next packer unit.

In order to take a measurement or sample at a desired level in bore hole 10 after the packers 15 have been inflated, the probe or other instrument 90 is lowered with its stop arm 97 retracted until the probe is just below the coupler located at the desired level. Then the probe is raised with the stop arm extended until the probe is a little above said coupler, and when the probe is lowered again, the stop arm is directed on to the stop surface 109 of coupler 18 to stop the probe in the correct operating position to take a measurement or sample at the desired level. As the probe is raised during this maneuver, the stop arm is depressed when it contacts valve stem 62 so as not to open the valve 60 at this time.

We claim:

1. An isolating packer unit in a geological and geophysical measuring casing made up of a plurality of said units at different levels and through which can be moved instruments for taking measurements and samples in wells or bore holes at said different levels, each isolating packer unit comprising:

axially aligned and spaced measuring casings, a coupler tube connected at opposite ends to ends of the casings to interconnect the casings, said casings and tube forming a common passageway through which an instrument can be moved to take measurements and samples, a measuring port in the coupler tube permitting communication between the interior and exterior thereof, a valve normally closing the measuring port and operable from within the tube by said instrument to open said port, an elongate elastic packer tube mounted on and concentric with each casing, said each casing extending through its packer tube and beyond the ends thereof, securing means fastening the ends of each packer tube to the casing extending through the latter packing tube, and means for directing fluid from the top of the wall or bore hole in which the packer unit is located into both of said packer tubes to expand the packer tubes to engage the wall of said well or bore hole to isolate the measuring port of the coupler tube from the portions of the well or bore hole above and below the packer units.

2. An isolating packer unit as claimed in claim 1 in which said fluid directing means comprises an inflating port in each measuring casing, and check valves normally closing the inflating ports, said check valves opening under pressure from within their respective casings.

3. An isolating packer unit as claimed in claim 2 in which each check valve comprises a wide elastic band fitting around the respective casing and overlying the inflating port of said respective casing.

4. An isolating packer unit as claimed in claim 1 in which said fluid directing means comprises tubular means extending from the top of the wall or bore hole to said packer tubes and through which fluid can be directed thereinto to expand the packer tubes.

5. An isolating packer unit as claimed in claim 4 in which said tubular means comprises a first pipe extending from and opening into one end of each of said packer tubes, and a second pipe extending from and opening into the opposite end of each of said packer tubes, said pipes communicating with the interiors of their respective packer tubes, and each first pipe being adapted to be in communication with the top of the well or bore and each second pipe being adapted to be in communication with the first pipe of another packer tube.

6. An isolating packer unit as claimed in claim 5 in which the packer tubes are formed of moldable material, and each of said pipes extends through the material of its respective packer tube and is molded in said material.

7. An isolating packer unit as claimed in claim 5 in which an end of each of said pipes is molded into and extends through a protective insert formed of moldable material and fixed between an end of a packer tube and the casing to which said packer tube is secured.

8. An isolating packer unit as claimed in claim 7 in which each of said inserts has an inner surface shaped to fit around the surface of the casing, and an outer curved surface tapering laterally to form very thin side edges of the insert, whereby said insert is relatively thick in the longitudinal middle thereof and tapers to its side edges, the pipe of said insert extending through the thick middle thereof.

9. An isolating packer tube as claimed in claim 5 comprising;

a packer head for each of said pipes and fitting between an adjacent end of the packer tube and the casing thereof, each packer head having an axial bore into which an end of the casing tightly fits, said each pipe of the head being molded therein to open out in communication with the interior of the packer tube.

10. An isolating packer tube as claimed in claim 9 in which each of said packer heads has an axial groove formed in the wall of the bore thereof, said groove opening into the adjacent packer tube through an inner end of the head and said each pipe opening into said groove, and including a sealing ring in the packer head fitting tightly around the casing, said sealing ring being located between said groove and an outer end of the head.

11. An isolating packer unit as claimed in claim 1 in which the packer tubes are formed of moldable material, and the wall of each packer tube is thicker at each end thereof than in the center section between said ends.

* * * * *